US009840991B2

(12) United States Patent
Elia

(10) Patent No.: US 9,840,991 B2
(45) Date of Patent: Dec. 12, 2017

(54) FUEL PRIMING PUMP

(71) Applicant: Thomas V Elia, Boca Raton, FL (US)

(72) Inventor: Thomas V Elia, Boca Raton, FL (US)

( * ) Notice: Subject to any disclaimer, the term of this patent is extended or adjusted under 35 U.S.C. 154(b) by 69 days.

(21) Appl. No.: 15/088,795

(22) Filed: Apr. 1, 2016

(65) Prior Publication Data

US 2017/0051711 A1 Feb. 23, 2017

Related U.S. Application Data

(60) Provisional application No. 62/206,842, filed on Aug. 18, 2015.

(51) Int. Cl.

| | |
|---|---|
| ***F02M 37/16*** | (2006.01) |
| ***F02M 37/08*** | (2006.01) |
| ***F02M 37/00*** | (2006.01) |

(52) U.S. Cl.

CPC ..... *F02M 37/16* (2013.01); *F02M 37/0023* (2013.01); *F02M 37/08* (2013.01); *F02M 37/007* (2013.01)

(58) Field of Classification Search

CPC .... F02M 37/16; F02M 37/08; F02M 37/0023; F02M 37/007

See application file for complete search history.

(56) References Cited

U.S. PATENT DOCUMENTS

| | | | | |
|---|---|---|---|---|
| 2,573,864 | A * | 11/1951 | Moran | B66B 1/24 137/115.13 |
| 3,402,733 | A * | 9/1968 | McAlvay | F23K 5/02 137/197 |
| 4,373,479 | A * | 2/1983 | Billingsley | F02M 1/16 123/179.11 |
| 5,367,901 | A * | 11/1994 | Petersen | F02D 33/006 137/565.29 |
| 5,664,532 | A * | 9/1997 | August | F02M 37/16 123/179.11 |
| 5,727,603 | A * | 3/1998 | Langlois | B60K 15/03519 141/1 |
| 7,552,740 | B2 * | 6/2009 | Kabu | B01J 19/002 137/1 |
| 8,631,777 | B2 * | 1/2014 | Brown | B63H 21/38 123/179.11 |
| 9,085,365 | B2 * | 7/2015 | Kelnhofer | B64D 13/00 |
| 2014/0251472 | A1 * | 9/2014 | Woods | F16K 37/005 137/599.11 |
| 2016/0025117 | A1 * | 1/2016 | Engelhard | B01F 5/0423 137/9 |

* cited by examiner

*Primary Examiner* — Michael C Zarroli

(57) ABSTRACT

A means to prevent the obstruction of fuel flow from the fuel source to the intake of an internal combustion engine by having an alternate and path for fuel to flow between the fuel source and the intake of an internal combustion engine. This invention takes advantage of prior art using existing manual fuel system primer to pump fuel from the fuel source to the fuel intake of an internal combustion engine then after the engine is primed with fuel an adjacent but connected fuel line is then available creating an additional fuel path from the fuel source to the fuel intake of the internal combustion engine.

17 Claims, 2 Drawing Sheets

Tank Y connector
Fuel tank
Fuel line
Tank Y connectors
Fuel line
Fuel line
Fuel line clamp
Fuel filter pump
Fuel line
Fuel line
Fuel line

FUEL PRIMING PUMP

CROSS REFERENCE TO RELATED APPLICATIONS

This application is based upon and claims priority to U.S. Provisional Patent Application Ser. No. 62/206,842, entitled "Fuel primer and pump bulb bypass apparatus for outboard engines", filed on Aug. 18, 2015, the disclosure of which is hereby incorporated by reference in its entirety.

BACKGROUND OF THE INVENTION

The field of the invention pertains to a priming system for an internal combustion engine and more particularly to a priming system which allows an alternate direct path between the fuel source and the fuel intake of an internal combustion engine It is well know that flexible priming bulbs, which are manually squeezed to pump fuel from the fuel source to the intake of an internal combustion engine can fail over time. This failure can cause the fuel flow from the fuel source to the engine to be obstructed either partially or completely thus starving the engine of fuel causing either a reduction in revolutions per minute or complete engine failure.

SUMMARY OF THE INVENTION

In accordance with the present invention, there is provided a means to prevent the obstruction of fuel flow from the fuel source to the intake of an internal combustion engine by having an alternate path for fuel to flow between the fuel source and the intake of an internal combustion engine. This invention takes advantage of prior art using existing fuel system primer to pump fuel from the fuel source to the fuel flow intake of an internal combustion engine then after the engine is primed with fuel an adjacent but connected fuel line is available creating an alternate fuel path from the fuel source to the fuel intake of the internal combustion engine

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
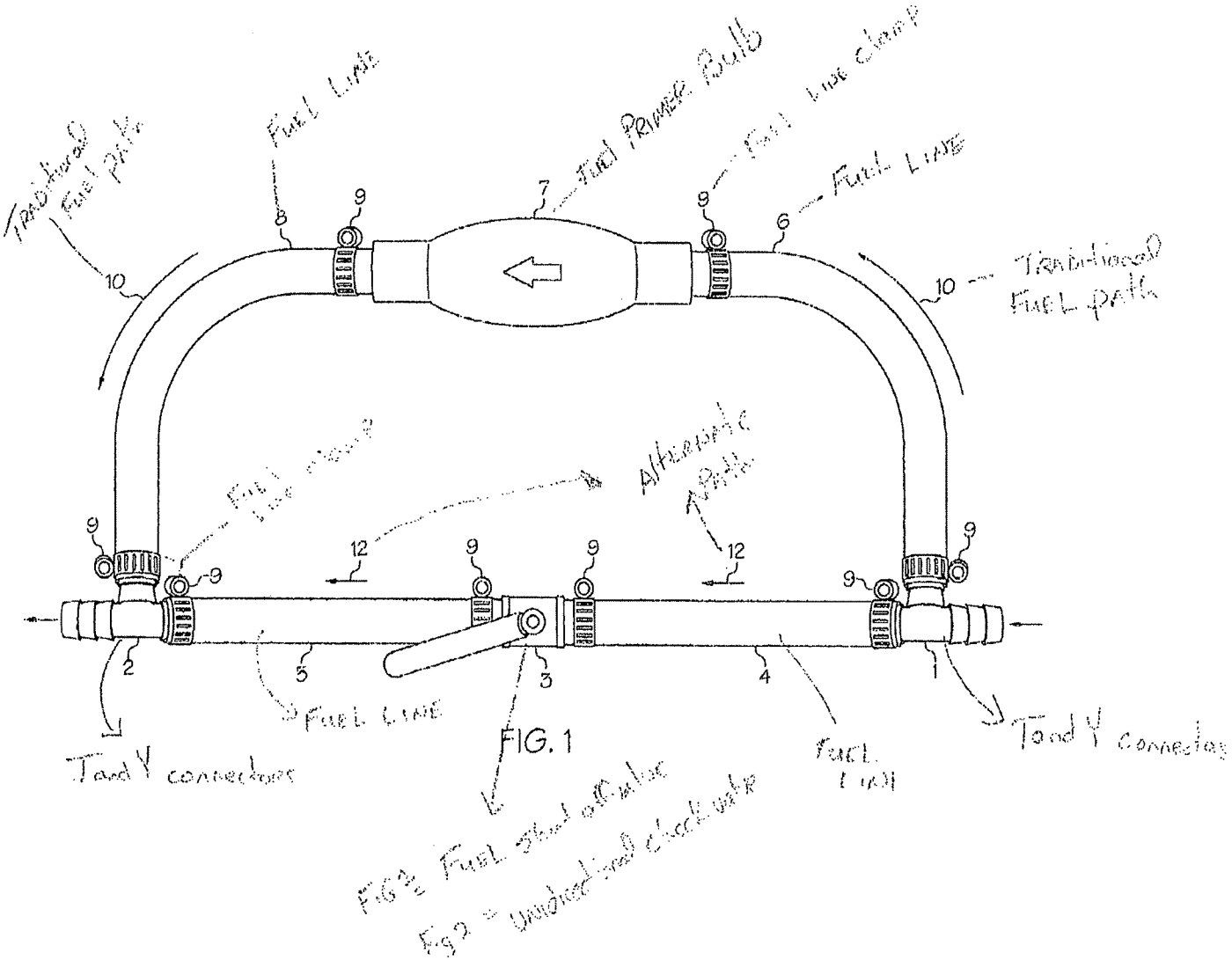
FIG. 1 is a perspective view of a Fuel priming pump utilizing a shut off valve FIG. 1 #3.

Unlike Other solutions in which the fuel priming systems have no redundancy in fuel flow to prevent failure caused by age, or malfunction of the primer bulb #7, the presently claimed invention provides an alternate, more direct route between the fuel source and the fuel intake of an internal combustion engine.

Further, the presently claimed invention prevents mechanical failure of the internal combustion engine due the failure of the manual fuel primer bulb #7.

Still further, the presently claimed invention allows fuel to be manually pumped from the fuel source to the fuel intake of an internal combustion engine The specification and figures are to be regarded in an illustrative rather than a restrictive sense, and all such modifications are intended to be included within the scope of the present invention. Any benefits, advantages or solutions to problems described herein with regard to specific examples are not intended to be construed as a critical, required or essential feature or element of any or all the claims.

The Detailed Description section, and not the Abstract section, is intended to be used to interpret the claims. The Abstract section may set forth one or more but not all examples of the invention, and the Abstract section is not intended to limit the invention or the claims in any way.

Non-Limiting Terminology

The terms "a" or "an," as used herein, are defined as one or more than one.

The use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

The term "coupled,", as used herein, is defined as "connected" although not necessarily directly.

The term "fuel line clamp" as used herein, includes multiple spring steel, plastic or radiator type fuel line securing hose clamps.

The term "T and Y connector" as used herein, is defined as a fuel line connector with at least one fuel line connection for input and at least one fuel line connection for output, It may be flexible or rigid, connection end where fuel line attaches may be threaded or barbed, composed of metal or a fuel tolerant plastic, PVC, or neoprene material.

The term "fuel line" as used herein, is defined as any type of rigid or flexible, metal, plastic, PVC, or rubber type of fuel tolerant tubing.

The term "pump" as used herein, is defined as any type of manual or electric, flexible or rigid device that sucks fluid in at least one opening and propels fluid out through at least one different opening.

unless stated otherwise, terms such as "first" and "second" are used to arbitrarily distinguish between the elements such terms describe. Thus, these terms are not necessarily intended to indicate temporal or other prioritization of such elements.

First Example of Fuel Primer Pump

Figure 2:
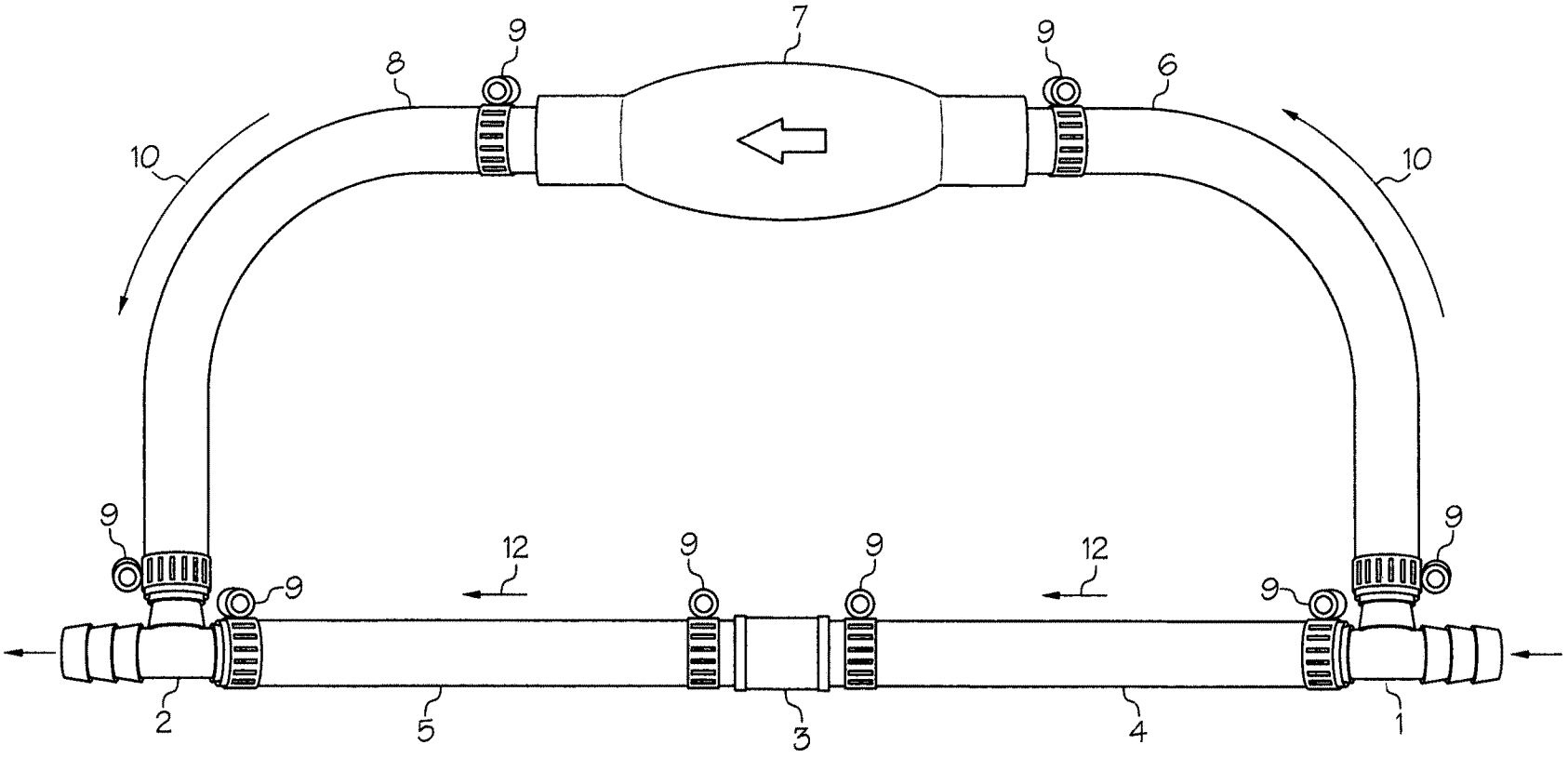
FIG. 2 is a perspective view of a Fuel priming pump utilizing a unidirectional check valve FIG. 2 #3.

Turning now to FIG. 1 and FIG. 2, wherein like numerals indicate like or corresponding parts throughout the views, a Fuel priming pump for introducing starting fuel into the intake system of an internal combustion engine and maintaining fuel flow to the intake system of an internal combustion engine in the event that that the fuel primer bulb #7 fails. The assembly comprises of two T and Y connectors #1,#2, for attaching fuel line in sizes between but not limited to 0.25 inch (0.635 cm) and 1 inch (2.54 cm). Four sections of fuel line between the sizes but not limited to 0.25 inch (0.635 cm) and 1 inch (2.54 cm) #4,#5,#6,#8. A fuel primer bulb #7 as well as either a unidirectional check valve FIG. 2. #3, or a shut off valve FIG. 1. #3 which can be manually opened and closed. It also includes multiple spring steel, plastic or radiator type fuel line clamps #9 which are used to securely fasten the fuel line segments #4,#5,#6,#8 to the T and Y fuel line connectors #1,#2, as well as the fuel primer bulb #7, and the Fuel shut off valve FIG. 1. #3 or the unidirectional check valve FIG. 2. #3.

The Fuel priming pump allows fuel to travel between the fuel source and the intake system of an internal combustion engine via 2 pathways, The traditional fuel path #10, through the fuel primer bulb and an alternate pathway #12, which bypasses the fuel primer bulb #7.

Operation of the fuel priming pump, involves priming the internal combustion engine with fuel. During this operation the Fuel shut off valve FIG. 1. #3 is manually set to the closed position blocking the back flow of fuel to the fuel source via the alternate fuel path #12, if a unidirectional check valve is used FIG. 2. #3 then no manual manipulation is required. The fuel priming bulb #7 is then manually activated pumping fuel from the Fuel source through the first T and Y connector #1, it then travels through fuel line #6, into the fuel priming bulb #7. The fuel then exits the fuel priming bulb #7 to fuel line #8 which connects to the second T and Y connector #2, which follows the fuel path #10. The Fuel will then exit the Fuel priming pump and travels to the intake system of the internal combustion engine to prime the engine. The Fuel cannot back flow through fuel line #5 because the shut off valve FIG. 1 #3 is closed, or a unidirectional check valve FIG. 2. #3 is in place to prevent back flow of fuel away from the intake system of the internal combustion engine.

Once the internal combustion engine is primed then the fuel shut off valve FIG. 1 #3, is manually placed in the open position allowing an alternate fuel path#12, to the intake of the internal combustion engine, if a unidirectional check valve FIG. 2. #3, is used in place of the manual fuel shut off valve FIG. 1. #3, then no manual manipulation is needed to create an alternate Fuel path #12. Two independent fuel paths are available fuel path #10, and fuel path #12, thus allowing redundancy in the event of fuel flow obstruction caused by the failure of the fuel priming bulb #7.

Non-Limiting Examples

Although the invention is described herein with reference to specific examples, various modifications and changes can be made without departing from the scope of the present invention as set forth in the claims below.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A fuel priming pump system comprising:

a first connector with at least one inlet and at least two outlets;

a second connector with at least two inlets and at one outlet;

a first fuel line defining a first fuel line fluid path coupled to one of the two outlets of the first connector and coupled to one of the two inlets of the second connector;

a valve disposed in-line with the first fuel line to block fluid flow therethrough;

a second fuel line defining a second fuel line fluid path coupled to second of the two outlets of the first connector and the second of the two inlets of the second connector; and a fuel primer bulb disposed in-line with the second fuel line to provide pressure towards the second inlet of the second connector, the pump for allowing fluid to flow from the second of the outlets of the first connector to the second of the two inlets of the second connector, when the valve is set to block fluid flow through the first fuel line fluid path.

2. The fuel priming pump system of claim 1, wherein the valve disposed in-line with the first fuel line is a shutoff valve.

3. The fuel priming pump system of claim 1, wherein the valve disposed in-line with the first fuel line is a unidirectional check valve.

4. The fuel priming pump system of claim 1, wherein the fuel primer bulb is manually operated priming bulb.

5. The fuel priming pump system of claim 1, wherein the fuel primer bulb is an electrically operated priming pump.

6. The fuel priming pump system of claim 1, wherein the first fluid connector is one of a T-shaped and a Y-shaped fitting.

7. The fuel priming pump system of claim 5, where the second fluid connector is one of a T-shaped and a Y-shaped fitting.

8. The fuel priming pump system of claim 6, where the first fluid connector and the second connector is one of a T-shaped and a Y-shaped fitting have barbed-type connectors and the first fuel line and the second fuel line are flexible fuel tolerant plastic fuel line for joining therewith.

9. The fuel priming pump system of claim 8, wherein the flexible fuel tolerant plastic fuel line is joined each of the first connector and the second fluid connector using a fuel line clamps.

10. The fuel priming pump system of claim 9 wherein the flexible fuel tolerant plastic fuel line is between 0.25 inch (0.635 cm) and 1 inch (2.54 cm) in diameter.

11. A fuel priming pump system provides fuel from a fuel source to an intake system of an internal combustion engine and additionally allowing a bypass fuel path from the fuel source to the intake system of an internal combustion engine the fuel priming pump system comprising:

a fuel primer bulb as part of a primary fuel path when manually activated will pump fuel from a fuel source to a fuel intake system of an internal combustion engine;

a valve is used to block fuel flow from the bypass fuel path which allows the fuel primer bulb to pump in one direction from the fuel source to the fuel intake system of an internal combustion engine;

a first fuel connector that splits the fuel flow from the fuel source to a bypass fuel path and to the fuel primer bulb;

a second fuel connector that merges the fuel coming from the fuel primer bulb and the bypass fuel path, to the fuel intake system of the internal combustion engine;

a first set of fuel lines defining a primary fuel path that allows fuel to flow between the first fuel connector to the fuel primer bulb and to the second fuel connector, and a first set of fuel line clamps for securely connecting to the first set of fuel lines to the first fuel connector, the fuel primer bulb and the second fuel connector, when manually activated will pump fuel from the fuel source to the fuel intake system of an internal combustion engine; and a second set of fuel lines defining a bypass fuel path that allow fuel to flow between the first fuel connector towards a shut off valve or a unidirectional check valve and to the second fuel connector, and a second set of fuel line clamps for securely connecting to the second set of fuel lines to the first fuel connector, the shut off valve or unidirectional check valve and the second fuel connector, thereby blocking fuel flow from the bypass fuel path which allows the fuel primer bulb to pump in one direction from the fuel source to the fuel intake system of an internal combustion engine.

12. A fuel priming pump system in accordance with claim 11, wherein a fuel primer bulb when manually activated will pump fuel from the fuel source to the fuel intake of an internal combustion engine.

13. A fuel priming pump system in accordance with claim 11, wherein the valve is one of a shut off valve or unidirectional check valve.

14. A fuel priming pump system in accordance with claim 11, wherein the first fuel connector splits the fuel flow from the fuel source to the bypass fuel path and to the fuel primer bulb comprises a barbed T or a Y connector.

15. A fuel priming pump system in accordance with claim 11, wherein the second fuel connector merges the fuel coming from the fuel primer bulb and the bypass fuel path to the fuel intake system of an internal combustion engine comprises a T or a Y connector.

16. A fuel priming pump system in accordance with claim 11, wherein the first set of fuel lines are flexible fuel lines.

17. A fuel priming pump system in accordance with claim 16, wherein the second set of fuel lines are flexible fuel lines.

* * * * *